US006082726A

United States Patent [19]

Inoue et al.

[11] Patent Number: 6,082,726

[45] Date of Patent: Jul. 4, 2000

[54] SHEET SUPPLY ROLLER FOR USE IN SHEET SUPPLY UNIT

[75] Inventors: Mitsuaki Inoue, Tsu; Kazumasa Makino, Nagoya; Tetsuo Asada, Kuwana, all of Japan

[73] Assignee: Brother Kogyo Kabushiki Kaisha, Nagoya, Japan

[21] Appl. No.: 09/102,229

[22] Filed: Jun. 22, 1998

[30] Foreign Application Priority Data

Jun. 30, 1997 [JP] Japan ..... 9-173537

[51] Int. Cl.[7] ..... B65H 5/22

[52] U.S. Cl. ..... 271/4.08; 271/119; 271/121

[58] Field of Search ..... 271/119, 121, 271/124, 4.08

[56] References Cited

U.S. PATENT DOCUMENTS 5,374,047 12/1994 Tsukamoto et al. ..... 271/121
5,582,399 12/1996 Sugiura ..... 271/121
5,584,475 12/1996 Asada ..... 271/121

FOREIGN PATENT DOCUMENTS 0178124 7/1990 Japan ..... 271/119

*Primary Examiner*—H. Grant Skaggs
*Attorney, Agent, or Firm*—Oliff & Berridge, PLC

[57] ABSTRACT

A sheet supply unit for use in an image forming device. The sheet supply unit includes a sheet supply roller rotatable in a rotational direction. The sheet supply roller has a circumferential surface both made of a resilient member. The circumferential surface has a first contacting portion and a last contacting portion. The first contacting portion has a width which increases in the rotational direction, and the last contacting portion has a width which decreases in the rotational direction. This enables a sheet to smoothly come into contact with and separated from the circumferential surface. Therefore, the sheet is prevented from being damaged by a sharp increase of pressing force. Also, redundant supply of sheets can be prevented.

20 Claims, 11 Drawing Sheets

SHEET SUPPLY ROLLER FOR USE IN SHEET SUPPLY UNIT

BACKGROUND OF THE INVENTION

1. Field of the Invention

The present invention relates to a sheet supply unit for use in an image forming device, such as a copying machine, a laser printer, and a facsimile device, for supplying one sheet at a time from a stack of sheets.

2. Description of Related Art

There has been known a sheet supply unit for use in various kinds of image forming devices. The sheet supply unit is for supplying one sheet at a time from a stack of sheets to an image forming unit.

As shown in FIGS. 1 and 2, a conventional sheet supply unit 1 includes a sheet supply roller 2, collars 10, a separation pad 3, a pad urging member 4, and guide rollers 12, 13. The sheet supply roller 2 is rotatable in a direction indicated by an arrow A, and is made of a resilient material. The sheet supply roller 2 has a circumferential surface 8 and a retracted surface 9 retracted from the circumferential surface 8 in a radial direction. Shoulders 14*a*, 15*a* are formed between the circumferential surface 8 and retracted surface 9.

As shown in FIG. 2, the collars 10 are formed in a disc like shape. The collars 10 are rotatably disposed in a coaxial relation with the sheet supply roller 2 and sandwich the sheet supply roller 2 therebetween. Each collar 10 is formed so that its peripheral surface is retracted radially inwardly from the circumferential surface 8 of the supply roller 2, and protrudes radially outwardly from the retracted surface 9.

The pad urging member 4 is disposed in confrontation with the sheet supply roller 2 and the collars 10. The pad urging member 4 includes a pad holder 5, stoppers 6, and springs 7. The pad holder 5 has a sheet receiving portion 5*a* at an upper end. The sheet receiving portion 5*a* has an engraved upper surface where the separation pad 3 is attached. The stoppers 6 are disposed at fixed positions adjacent to a lower end of the pad holder 5. The springs 7 are disposed between the stoppers 6 and the sheet receiving portion 5*a* for urging the pad holder 5 toward the sheet supply roller 2 and the collars 10.

As shown in FIG. 1, when the circumferential surface 8 is in confrontation with the separation pad 3, the circumferential surface 8 contacts a sheet S interposed between the sheet supply roller 2 and the separation pad 3. At this time, the collars 10 are separated from the sheet S. On the other hand, when the retracted surface 9 is brought into confrontation with the separation pad 3, the collars 10 come into contact with the sheet S, and the sheet supply roller 2 is separated from the sheet S.

The guide rollers 12, 13 are rotatably disposed at a downstream side of the sheet supply roller 2 with respect to a sheet feed direction indicated by an arrow B. The guide rollers 12, 13 contact each other so as to develop a nip portion therebetween.

Next, a sheet supply operation of the above sheet supply unit 1 will be described. First, the retracted surface 9 is in confrontation with the separation pad 3 with a sheet S interposed therebetween. At this time, the sheet S is in contact with the collars 10, and the sheet supply roller 2 is suspended above the sheet S without contacting the sheet S. Then, the sheet supply roller 2 is driven to rotate in the direction A. When the shoulder 15 comes in contact with the sheet S, the collars 10 are separated from the sheet S. When the sheet supply roller 2 further rotates while the circumferential surface 8 is in contact with the sheet S, the sheet S is fed in the feed direction B.

When the shoulder 14 separates from the sheet S, the collars 10 are brought into contact with the sheet S so that the sheet supply roller 2 is kept from contacting the sheet S. The sheet supply roller 2 stops rotating in this state. By this time, a leading edge of the sheet S reaches the nip portion developed between the guide rollers 12, 13. The sheet S is further fed by the rotational movement of the guide rollers 12, 13. Because the collars 10 are in contact with the sheet S, the collars 10 rotate idly in accordance with the feeding movement of the sheet S.

However, the above-described sheet supply roller 2 has some drawbacks. As shown in FIG. 1, a step 15*a* is formed between the peripheral surface of the collar 10 and the shoulder 15. Because of the step 15*a*, when the shoulder 15 comes into contact with a sheet S, the sheet S is subject to a sharp increase of pressing force between the shoulder 15 and the separation pad 3. At this moment, an additional sheet may be allowed to enter between the sheet supply roller 2 and the separation pad 3. This causes redundant supply of sheets. Also, the sheet S may creased when strongly pressed by the shoulder 15.

In order to solve the above problems, it is conceivable to form a sheet supply roller in an elliptical shape without a shoulder. However, in this case, a first contact position at which a sheet S comes into contact with the sheet supply roller will be a position retracted from the shoulder 15 in the radial direction. This may cause failure on supplying sheet, that is, no sheet may be supplied.

Also, it is conceivable to provide a cam member to the sheet supply roller 2 so that no shoulder would be formed. However, this may cause failure on supplying sheet also.

Also, a step 14*a* is formed between the peripheral surface of the collar 10 and the shoulder 14. Because of the step 14*a*, at the moment a sheet S is separated from the shoulder 14 and brought into contact with the collars 10, the sheet S is subject to no pressing force. This is because the pad urging member 4 cannot respond quickly enough to keep generating constant pressing force on the sheet S. Then, at the moment, an additional sheet may be allowed to enter between the collars 10 and the separation pad 3, thereby causing redundant supply of sheet.

SUMMARY OF THE INVENTION

It is an objective of the present invention to solve the above-described problems and also to provide a sheet supply unit capable of reliably supply sheets one at a time.

In order to achieve the above and other objectives, there is provided a sheet supply unit including a sheet supply roller and a separation pad. The sheet supply roller feeds a recording medium in a sheet feed direction while rotating in a rotational direction. The sheet supply roller has a width in a widthwise direction perpendicular to the sheet feed direction and a peripheral member formed of a resilient material. The peripheral member has a circumferential surface that contacts with the recording medium and a retracted surface retracted radially inwardly from the circumferential surface. The circumferential surface is formed with a first contacting portion having a width that increases in the rotational direction. The separation pad is disposed in confrontation with the peripheral member of the sheet supply roller.

There is also provided a In order to achieve the above and other objectives, there is provided a sheet supply unit including a sheet supply roller and a separation pad. The sheet supply roller feeds a recording medium in a sheet feed direction while rotating in a rotational direction. The sheet supply roller has a width in a widthwise direction perpendicular to the sheet feed direction and a peripheral member formed of a resilient material. The peripheral member has a circumferential surface that contacts with the recording medium and a retracted surface retracted radially inwardly from the circumferential surface. The circumferential surface is formed with a last contacting portion having a width that decreases in the rotational direction. The separation pad is disposed in confrontation with the peripheral member of the sheet supply roller.

Further, there is provided an image forming device including a frame defining an internal space, a sheet supply unit, a print unit, and a discharge member. The sheet supply unit, the print unit, and the discharge member are disposed in the internal space of the frame. The sheet supply unit supplies a recording medium in a sheet feed direction. The print unit prints an image on the recording medium supplied by the sheet supply unit. The discharge member discharges the recording medium with an image formed thereon out of the frame. The sheet supply unit includes a sheet supply roller and a separation pad. The sheet supply unit feeds the recording medium in a sheet feed direction while rotating in a rotational direction and has a width in a widthwise direction perpendicular to the sheet feed direction. The sheet supply roller has a peripheral member formed of a resilient material. The peripheral member has a circumferential surface that contacts the recording medium and a retracted surface retracted radially inwardly from the circumferential surface. The circumferential surface is formed with a first contacting portion having a width that increases in the rotational direction. The separation pad is disposed in confrontation with the peripheral member of the sheet supply roller.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Figure 1:
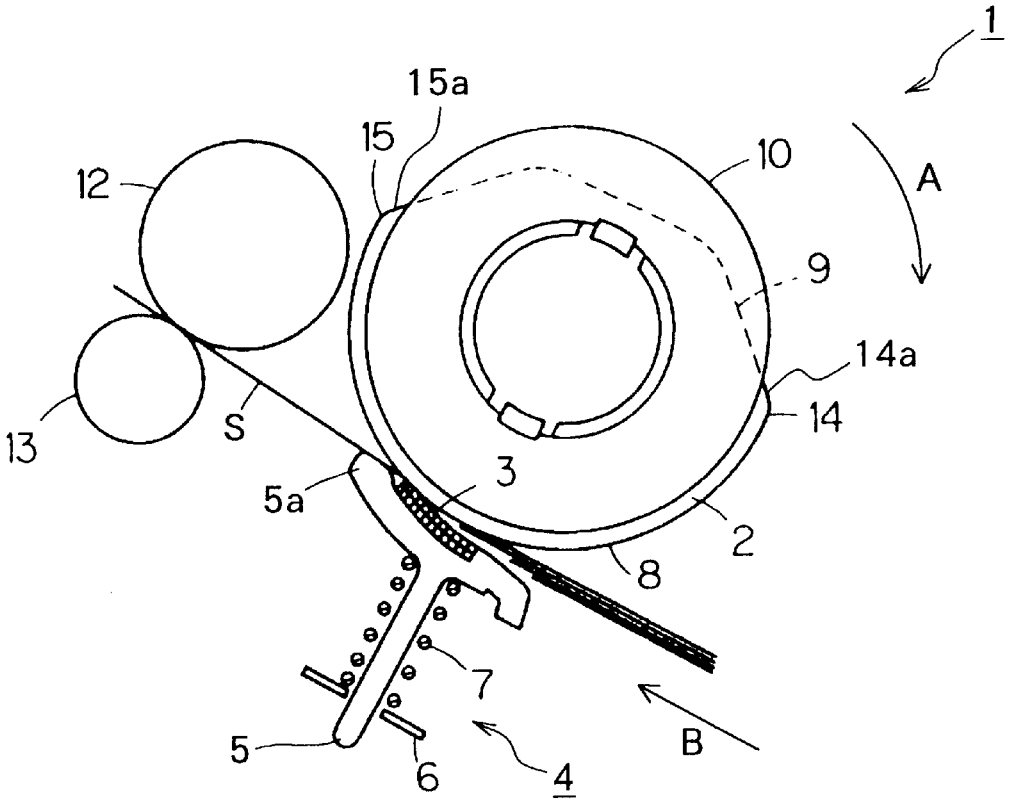
FIG. 1 PRIOR ART
FIG. 1 is a plan view showing a conventional sheet supply unit.
Figure 2:
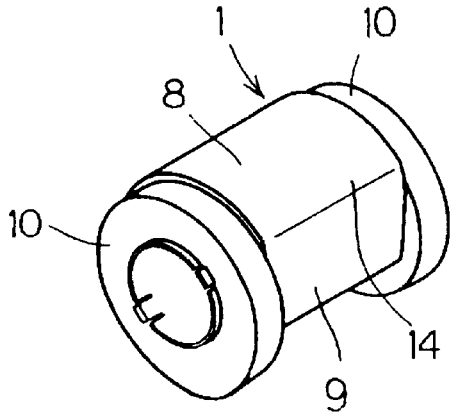
FIG. 2 PRIOR ART
FIG. 2 is a perspective view showing a sheet supply roller with collars mounted thereon of the conventional sheet supply unit of FIG. 1.

A sheet supply unit according to a preferred embodiment of the present invention will be described while referring to the accompanying drawings wherein like parts and components are designated by the same reference numerals to avoid duplicating description.

In the following description, the expressions "front", "rear", "left", "right", "above", "bottom", "upper", and "lower" are used to define the various parts when the printer is disposed in an orientation in which it is intended to be used.

Figure 3:
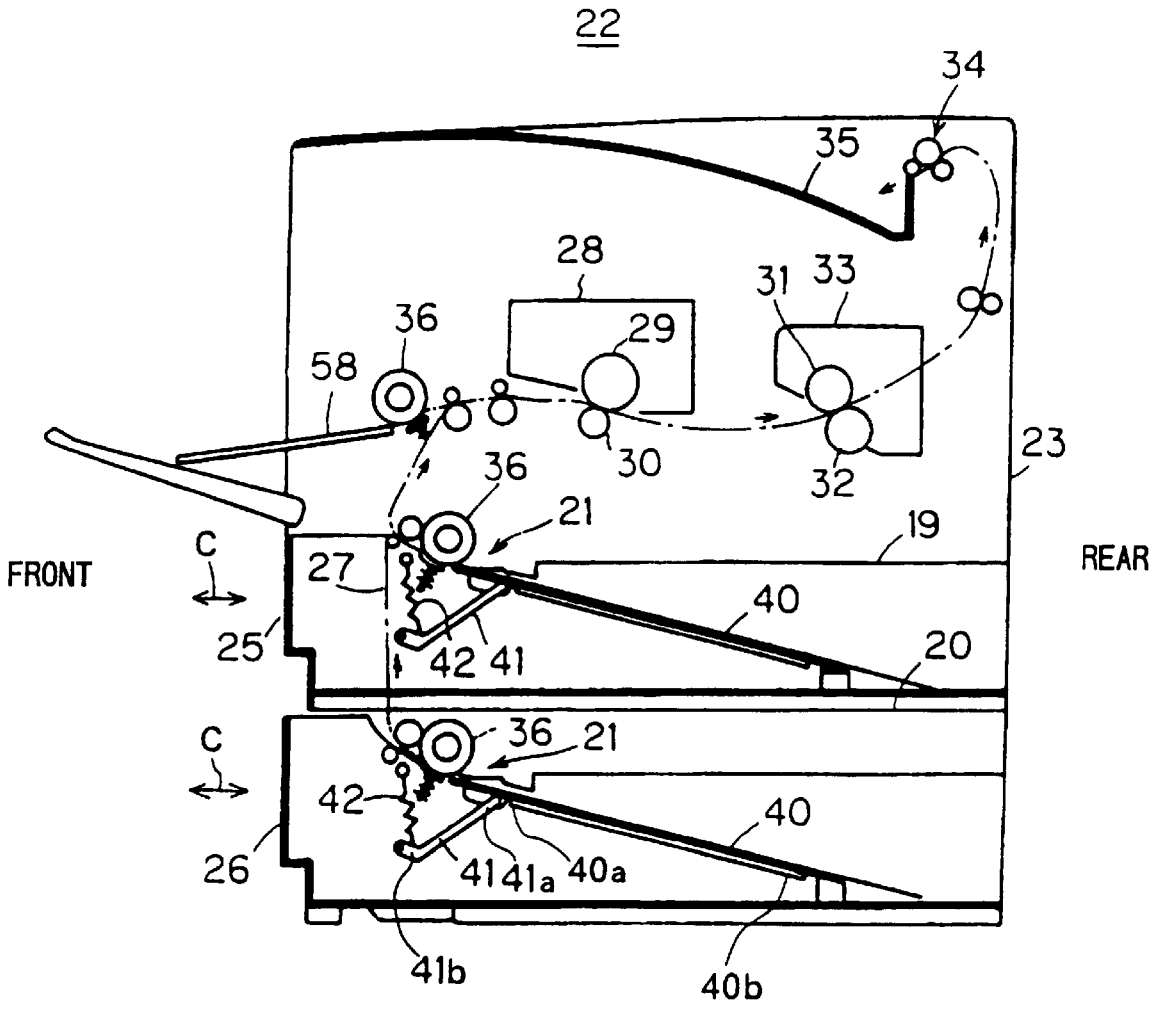
FIG. 3 is a plan view showing an internal of an image forming device including a sheet supply unit according to an embodiment of the present invention.

First, a laser printing device 22 including a sheet supply unit 21 according to an embodiment of the present invention will be described while referring to FIG. 3. As shown in FIG. 3, the laser printing device 22 includes a frame 23, first and second cassette housings 19, 20, an image forming unit 28, a fixing unit 33, and a tray 35.

The first and second cassette housings 19, 20 are disposed in a stacked condition at a lower position in the frame 23. The cassette housings 19, 20 are for housing a first and second cassettes 25, 26, respectively, so as to be slidable in directions indicated by arrows C. Each cassette 25, 26 has a frame 24, a receiving plate 40, an arm 41, a spring 42, and the sheet supply unit 21.

The receiving plate 40 is provided for supporting sheets 27 in a stacked state, and has a front end 40*a* and a rear end 40*b*. The rear end 40*b* is attached to the frame 24 at a lower portion such that the receiving plate 40 is pivotably movable about the rear end 40*b*. The arm 41 is provided for supporting the receiving plate 40. The arm 41 has a first end 41*a* attached adjacent to the front end 40*a* of the receiving plate 40 and a second end 41*b* attached to the frame 24. The arm 41 is pivotably movable about both the first end 41*a* and the second end 41*b*.

The sheet supply unit 21 has a sheet supply roller 36 to be described later, and is disposed adjacent to the front end 40*a* of the receiving plate 40 for supplying sheets 27 from the receiving plate 40 in a sheet feeding direction. The spring 42 is attached to the arm 41 to urge the arm 41 to pivot in a counterclockwise direction about the second end, resulting in urging the receiving plate 40 toward the sheet supply roller 36. In this way, sheets 27 supported by the receiving plate 40 are urged toward the sheet supply unit 21.

The image forming unit 28 and the fixing unit 33 are disposed in an upper portion of the frame 23. The image forming unit 28 includes a photosensitive drum 29, a transfer roller 30, a toner cartridge, and a charging unit (not shown). The photosensitive drum 29 and the transfer roller are disposed to contact each other, thereby developing a nip portion therebetween. The image forming unit 28 forms a toner image on a sheet 27 at the nip portion. The fixing unit 33 includes a thermal roller 31 and a pressing roller 32 in contact with the thermal roller 31. A toner image formed on a sheet 27 is thermally fixed onto the sheet 27 by the thermal roller 31 and the pressing roller 32.

Next, a printing operation of the above-described laser printing device 22 will be described. Sheets 27 supported on the receiving plate 40 are supplied one at a time by the sheet supply unit 21 in the sheet feed direction. When the sheet 27 reaches the nip portion between the photosensitive drum 29 and the transfer roller 30, a toner image is transferred from the photosensitive drum 29 onto the sheet 27 while the sheet 27 is fed in the sheet feed direction. The sheet 27 with the toner image formed thereon is further transported to the fixing unit 33. As the sheet 27 is fed between the thermal roller 31 and the pressing roller 32, the toner image is thermally fixed onto the sheet 27. Then, the sheet 27 is discharged out of the frame 23 via discharge number 34 onto the tray 35.

Figure 10:
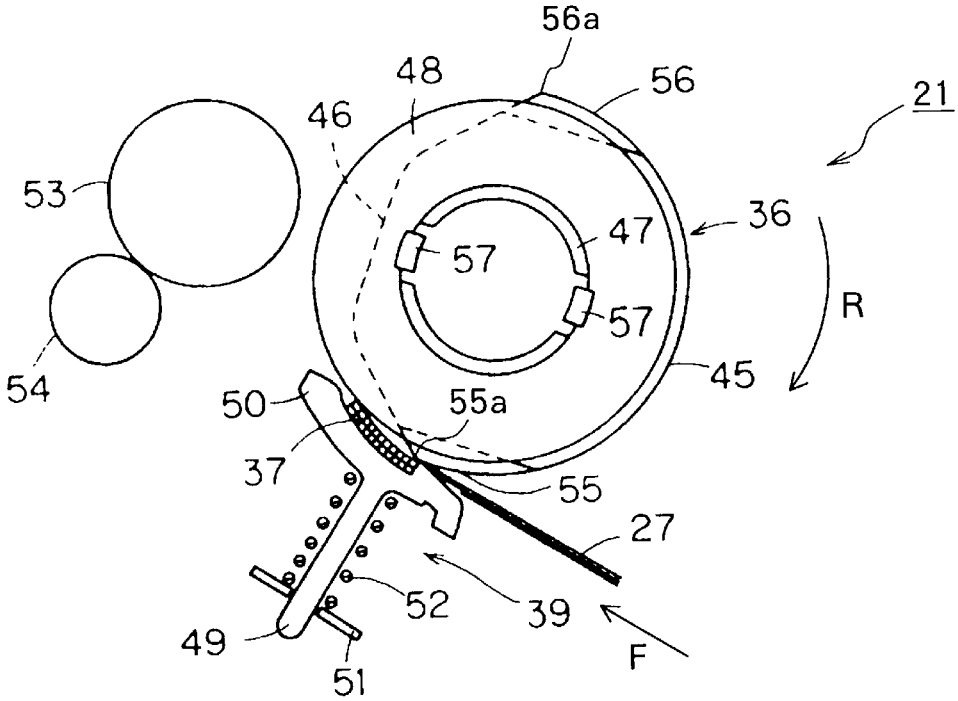
FIG. 10 is a plan view showing the sheet supply unit of the image forming device of FIG. 1, wherein a first contact portion of a surface member is in confrontation with a sheet to be supplied.

Next, the sheet supply unit 21 according to the embodiment of the present invention will be described while referring to FIGS. 4 to 13. As shown in FIG. 10, the sheet supply unit 21 includes a sheet supply roller 36, collars 48, a separation pad 37, a pad urging member 39, and guide rollers 53, 54. The sheet supply roller 36 and the collars 48 are in a coaxial relation and are rotatable in a direction indicated by an arrow R. The pad urging member 39 is disposed in confrontation with the sheet supply roller 36. The pad urging member 39 includes a pad holder 49, stoppers 51, and springs 52. The pad holder 49 has a pad holding portion 50 having an upper surface opposing the sheet supply roller 36. The upper surface of the pad holding portion 50 is formed with an engraved portion where the separation pad 37 is disposed. The stoppers 51 are disposed at fixed positions adjacent to a lower end of the pad holder 49. The springs 52 are disposed between the stoppers 51 and the holding portion 50 to urge the pad holder 49 upward so that the separation pad 37 presses selectively against the sheet supply roller 36 and the collars 48.

It should be noted that, as shown in FIG. 10, the sheet supply unit 21 is disposed such that the sheet supply roller 36 is positioned above and at a downstream side of the leading edge of the sheet 27.

The guide rollers 53, 54 are rotatably disposed at a downstream side of the sheet supply roller 36 in the sheet feed direction indicated by an arrow F. The guide rollers 53, 54 contact each other to develop a nip portion therebetween.

Figure 6:
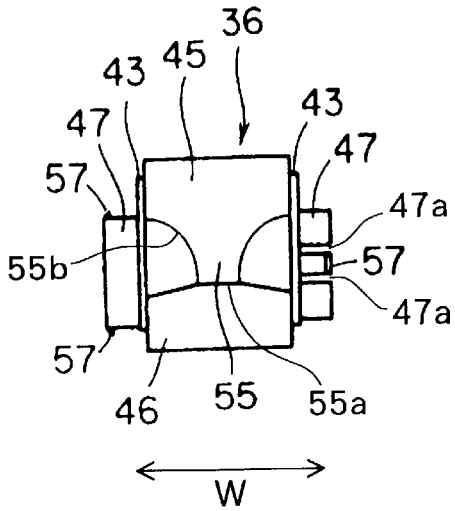
FIG. 6 is a plan view showing the sheet supply roller of FIG. 4 as viewed from the rear.

Next, a detailed description of the sheet supply roller 36 will be provided while referring to FIGS. 4 to 9. As shown in FIGS. 4 to 9, the sheet supply roller 36 has a width in a direction indicated by an arrow W, which is perpendicular to the sheet feed direction F. The sheet supply roller 36 includes a core 43 and a surface member 44. The core 43 is made of resin. The surface member 44 is formed around the core 43 from a resilient member, such as rubber, having a relatively large coefficient of friction. The surface member 44 has a circumferential surface 45 and a retracted surface 46 retracted radially inward from the circumferential surface 45. The circumferential surface 45 has a first contact portion 55 and a last contact portion 56. As shown in FIG. 6, the first contact portion 55 has a forward edge 55*a* and curved edges 55*b*. The forward edge 55*a* is positioned at the center of the sheet supply roller 36 in the widthwise direction W. The first contact portion 55 has a width that increases in the rotational direction R from the forward edge 55*a* following the curved edges 55*b*.

Figure 7:
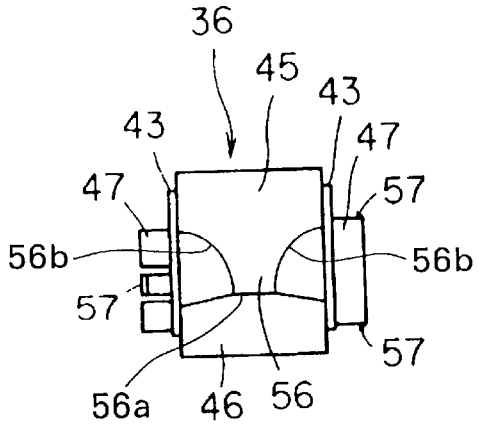
FIG. 7 is a plan view showing the sheet supply roller of FIG. 4 as viewed from the front.
Figure 8:
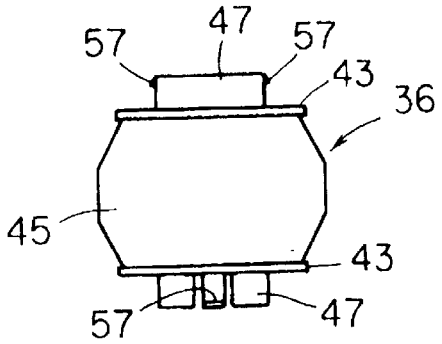
FIG. 8 is a plan view showing the sheet supply roller of FIG. 4 as viewed from above.
Figure 9:
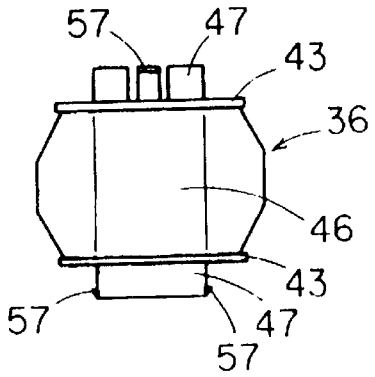
FIG. 9 is a plan view showing the sheet supply roller of FIG. 4 as viewed from below.

Also, as shown in FIG. 7, the last contact portion 56 has a rear edge 56*a* and curved edges 56*b*. The rear edge 56*a* is positioned at the center of the sheet supply roller 36 in the widthwise direction W. The last contact portion 56 has a width that decreases in the rotational direction R following the curved edges 56*b* to the rear edge 56*a*.

The core 43 has a pair of cylindrical members 47 integrally formed with the core 43 such that each cylindrical members 47 protrudes outwardly from a side surface of the core 43 in the widthwise direction. Each cylindrical member 47 is formed with two pairs of slits 47*a*. The pairs of slits on one cylindrical member 47 oppose each other in a first direction perpendicular to the width direction W. The other pairs of silts on the other cylindrical member 47 oppose each other in a second direction perpendicular both to the first direction and the width direction. A portion of the cylindrical member 47 sandwiched between each pair of slits 47*a* is formed with a stopper 57 that protrudes outward in the radial direction of the sheet supply roller 36.

Figure 4:
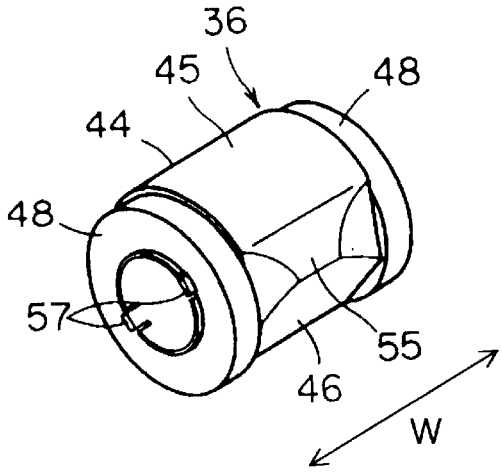
FIG. 4 is a perspective view showing a sheet supply roller with collars mounted thereon according to an embodiment of the present invention.
Figure 5:
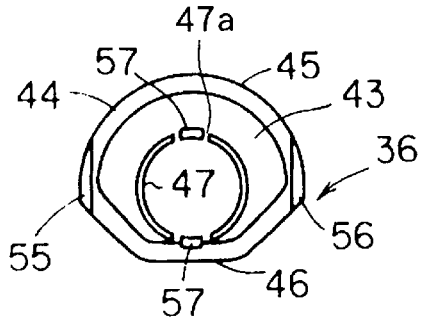
FIG. 5 is a plan view showing the sheet supply roller of FIG. 4 as viewed from the left.

Next, the collars 48 will be described while referring to FIG. 4. The collars 48 are detachably and rotatably disposed on the cylindrical members 47 such that the collars 48 sandwich the core 43 and the circumferential surface 45 therebetween. The stoppers 57 keep the collars 48 from being detached accidentally from the cylindrical members 47. Each collar 48 has a peripheral surface which is retracted inward from the circumferential surface 45 of the sheet supply roller 36 in the radial direction, but which protrudes outward from the retracted surface 46. With this configuration, when the circumferential surface 45 is in confrontation with the separation pad 37, the sheet supply roller 36 contacts the separation pad 37. At this time, the collar is suspended above the separation pad 37 without contacting the separation pad 37. On the other hand, when the retracted surface 46 is in confrontation with the separation pad 37, the collars 48 are in contact with the separation pad 37, and the sheet supply roller 36 is suspended above the separation pad 37 without contacting the separation pad 37. The separation pad 37 is formed of a resilient material having a slightly smaller coefficient of friction than the material forming the surface member 44.

Next, sheet supply operation of the above-described sheet supply unit 21 will be described while referring to FIGS. 10 to 13.

Before a sheet supply operation is started, the retracted surface 46 of the sheet supply roller 36 is in confrontation with the upper most sheet 27 of sheets stacked on the receiving plate 40. As a result, the collars 48 are in contact with the sheet 27. Then, the sheet supply roller 36 are driven to rotate in the rotational direction R. The forward edge 55*a* of the first contact portion 55 comes in contact with the sheet 27 as shown in FIG. 10. At this time, because the forward edge 55*a* has a small width and also because the surface member 44 is formed of a resilient material, the forward edge 55*a* is easily and greatly deformed inward in the radial direction when pressed against the separation pad 37 with the sheet 27 interposed therebetween. Therefore, the sheet 27 is not subject to sharp increase of pressing force from the forward edge 55*a*. This prevents redundant supply of sheets, and also prevents the sheet 27 from being creased. Further, because the forward edge 55*a* contacts the sheet 27 at an optimal position in the radial direction, failure of sheet supply can be prevented.

Figure 11:
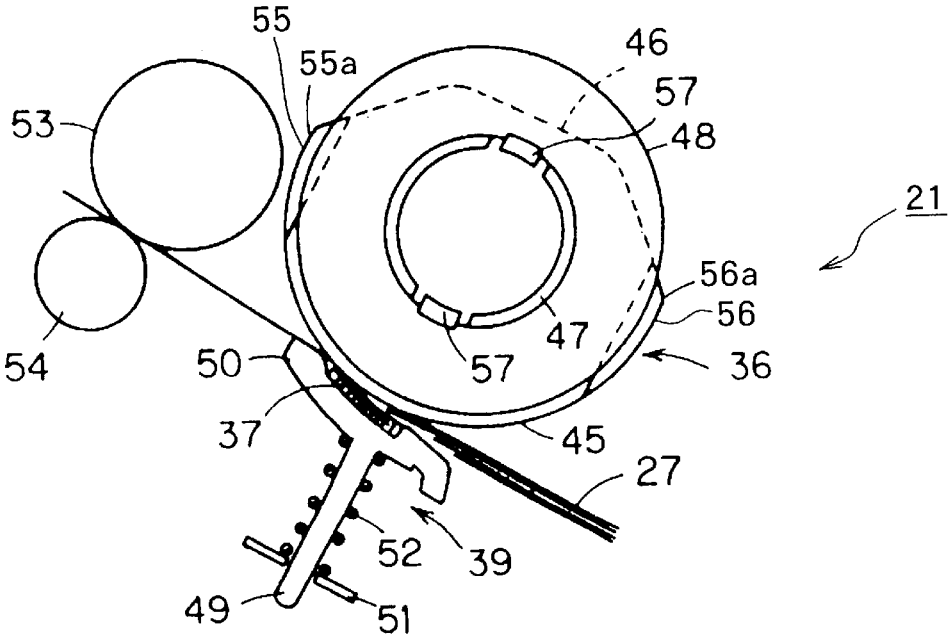
FIG. 11 is a plan view showing the sheet supply unit of FIG. 10.

As the sheet supply roller 36 further rotates, the area of the first contact portion 55 that contacts the sheet 27 increases as the first contact portion 55 feeds the sheet 27 in the sheet feed direction R. Then, as shown in FIG. 11, remaining portions of the circumferential surface 45 of the sheet supply roller 36 contacts the sheet 27, and feeds it further in the sheet feed direction R so that the leading edge of the sheet 27 reaches the nip portion developed between the guide rollers 53, 54.

Figure 12:
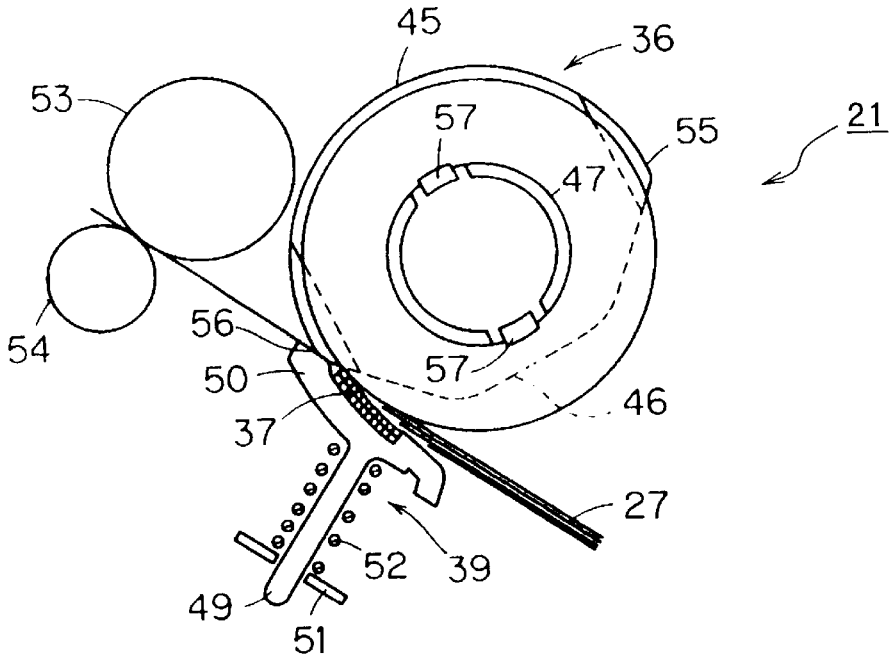
FIG. 12 is a plan view showing the sheet supply unit of FIG. 10, wherein a circumferential surface is in confrontation with the sheet.

Then, as shown in FIG. 12, the last contact portion 56 of the circumferential surface 45 comes in contact with the sheet 27. As the last contact portion 56 feeds the sheet 27, area of the last contact portion 56 that contacts the sheet 27 decreases, also the last contact portion 56 is gradually depressed radially inward. Then, the sheet 27 is separated from the rear edge 56*a* of the last contact portion 56 and brought in contact with the collars 48. Because the last contact portion 56 is narrow and easily depressed, the sheet 27 can be smoothly separated from the rear edge 56*a* and brought into contact with the collars 48. This prevents an additional sheet from entering between the collars 48 and the separation pad 37 even at the moment the sheet supply roller 36 is separated from the sheet 27. Therefore, redundant supply of sheets can be prevented.

Figure 13:
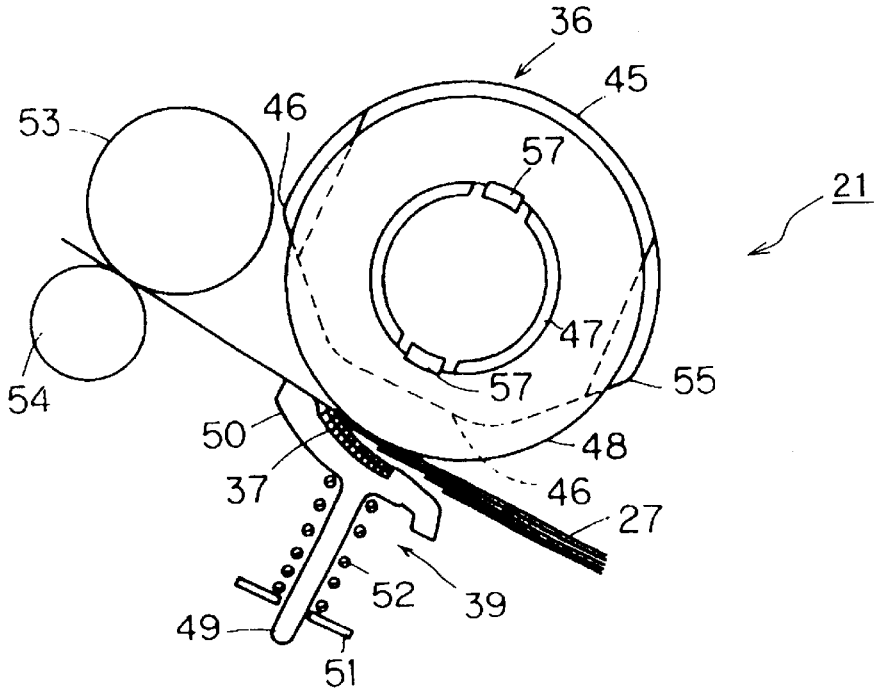
FIG. 13 is a plan view showing the sheet supply unit of FIG. 10, wherein a last contact portion f the circumferential surface is in confrontation with the sheet.
Figure 14:
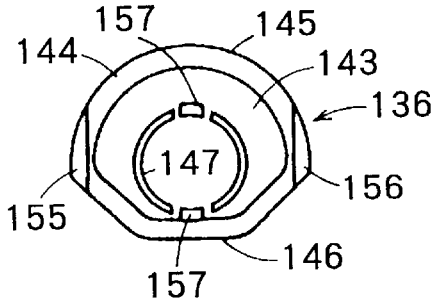
FIG. 14 is a plan view showing a sheet supply roller, as viewed from the left, according to a first modification of the embodiment of the present invention.

After the circumferential surface 45 is separated from the sheet 27, the retracted surface 46 confronts the sheet 27. As shown in FIG. 13, because the collars 48 are in contact with the sheet 27, the sheet supply roller 36 is suspended above the sheet 27. Then, the sheet supply roller 36 stops rotating in this state. The sheet 27 is further fed in the sheet feed direction R by rotational movement of the guide rollers 53, 54, and also the collars 48 idly rotate in accordance with the feeding movement of the sheet 27.

In this way, sheets 27 stacked on the receiving plate 40 are supplied one at a time in the sheet feed direction R. For supplying a subsequent sheet, the sheet supply roller 36 is driven to rotate, and the above-described process is repeated.

It should be noted that according to the present embodiment the first and last contact portions 55, 56 are formed by cutting off excess portions of the surface member 44. The first and last contact portions 55, 56 can also be formed by molding processes so that the surface member 44 will have a predetermined shape.

Also, the laser printing device 22 can include a manual sheet insert portion 58 shown in FIG. 3. In this case, an additional sheet supply unit 21 is also provided for the manual sheet insert portion 58.

Next, sheet supply rollers according to first, second, and third modification of the embodiment will be described while referring to FIGS. 14 to 28.

As shown in FIGS. 14–28, the roller 136, 236, 336 include a core 143, 243, 343, respectively and a surface member 144, 244, 344, respectively. The surface members 144, 244 and 344 have a circumferential surface 145, 245, 345 and a retracted surface 146, 246, 346. The circumferential surfaces 145, 245, 345 have a first contact portion 155, 255, 355 and a last contact portion 156, 256, 356. The first contact portions 155, 255, 355 all have a leading edge 155*a*, 255*a*, 355*a* and a curved edge 155*b*, 255*b*, 355*b*. The cores all have a cylindrical member 147, 247, 347 integrally formed with the respective core 143, 243, 343 such that each cylindrical member 147, 247, 347 protrudes outwardly from a side surface of the core 143, 243, 343.

Figure 15:
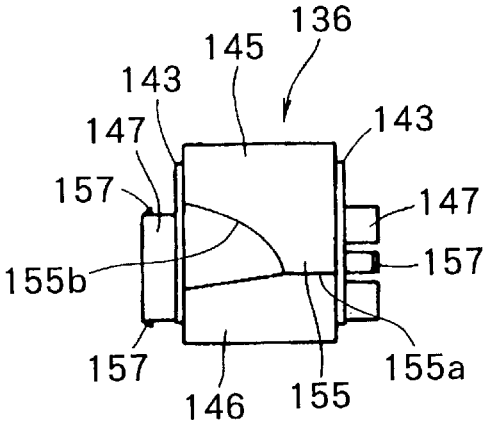
FIG. 15 is a plan view showing the sheet supply roller of FIG. 14 as viewed from the rear.
Figure 16:
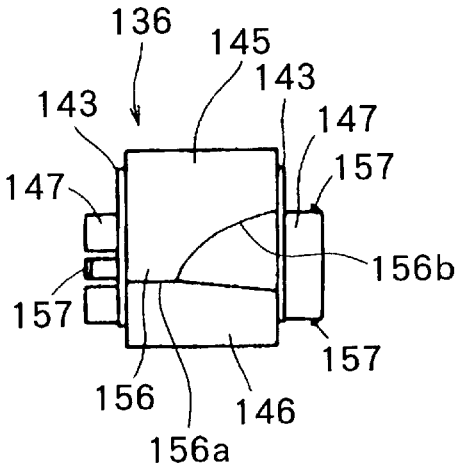
FIG. 16 is a plan view showing the sheet supply roller of FIG. 14 as viewed from the front.
Figure 17:
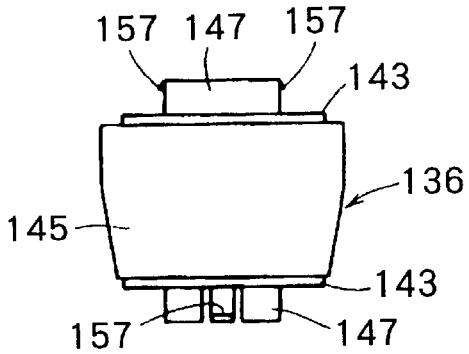
FIG. 17 is a plan view showing the sheet supply roller of FIG. 14 as viewed from above.
Figure 18:
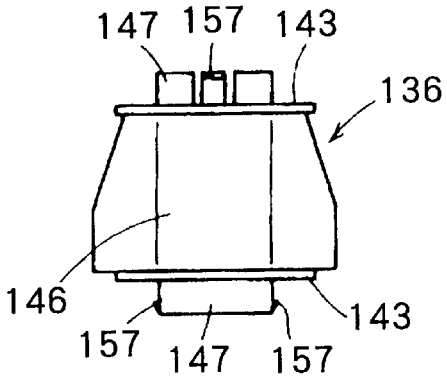
FIG. 18 is a plan view showing the sheet supply roller of FIG. 14 as viewed from below.

First, a sheet supply roller 136 according to the first modification will be described while referring to FIGS. 14 to 18. The sheet supply roller 136 is similar to the sheet supply roller 36 described above except for first and last contact portions 155, 156. As shown in FIGS. 14 to 18, the sheet supply roller 136 includes a core 143 and a surface member 144. The surface member 144 has a circumferential surface 145 and a retracted surface 146. The circumferential surface 145 has a first contact portion 155 and a last contact portion 156. The core 143 has a pair of cylindrical members 147 integrally formed with the core 143 such that each cylindrical members 147 protrudes outwardly from a side surface of the core 143 in the widthwise direction. The cylindrical members 147 are formed with a stopper 157 that protrudes outward in the radial direction of the sheet supply roller 136. As shown in FIG. 15, the first contact portion 155 has an edge 155*a* positioned at a first side of the sheet supply roller 136 in the widthwise direction W rather than at the center. The first contact portion 155 has an edge 156*b* so that its width increases from the edge 155*a* toward the rotational direction R. Also, as shown in FIG. 16, the last contact portion 156 has an edge 156*a* positioned at a second side of the sheet supply roller 136 opposite from the first side in the widthwise direction W. The last contact portion 156 has a width which decreases toward the edge 156*a* in the rotational direction R.

Figure 19:
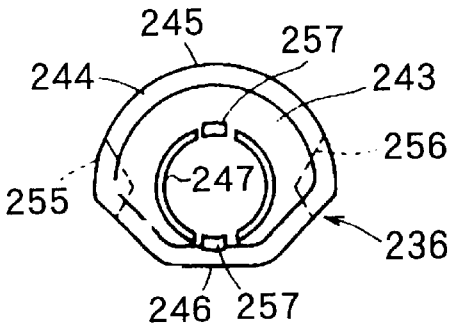
FIG. 19 is a plan view showing a sheet supply roller, as viewed from the left, according to a second modification of the embodiment of the present invention.
Figure 20:
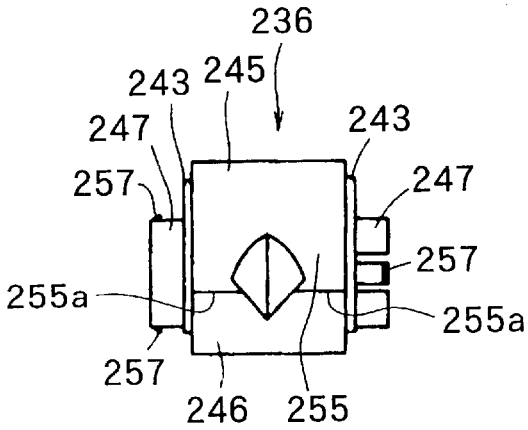
FIG. 20 is a plan view showing the sheet supply roller of FIG. 19 as viewed from the back.

Next, a sheet supply roller 236 of the second modified embodiment will be described while referring to FIGS. 19 to 23. The sheet supply roller 236 is similar to the above-described sheet supply roller 36 except that a surface member 244 and a core 243 are formed with first and second engraved portions 244*a*. As shown in FIG. 19 to 23, the surface member 244 has a circumferential surface 245 and a retracted surface 246. The circumferential surface 245 has a first contract portion 255 and a lost contact portion 256. The core 243 has a pair of cylindrical members 247 integrally formed with the core 243 such that each cylindrical members 247 protrudes outwardly from a side surface of the core 243 in the widthwise direction. The cylindrical members 247 are formed with a stopper 257 that protrudes outward in the radial direction of the sheet supply roller 236. As shown in FIG. 19, portions of the surface member 244 and the core 243 are cut away so as to form the engraved portions 244*a* at the center of the sheet supply roller 236 in the widthwise direction W. The engraved portions 244*a* have a V-shaped cross-sectional area as indicated by broken lines in FIG. 19. As a result, as shown in FIG. 20, a first contacting portion 255 has two edges 255*a* sandwiching the first engraved portion 244*a*. The first contacting portion 255 has a width which increases from the edges 255*a* in the rotational direction R.

Figure 21:
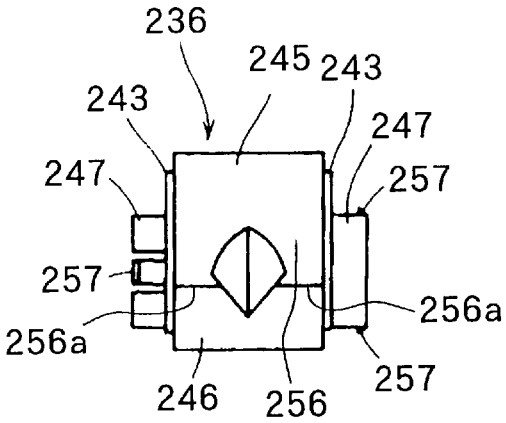
FIG. 21 is a plan view showing the sheet supply roller of FIG. 19 as viewed from the front.
Figure 22:
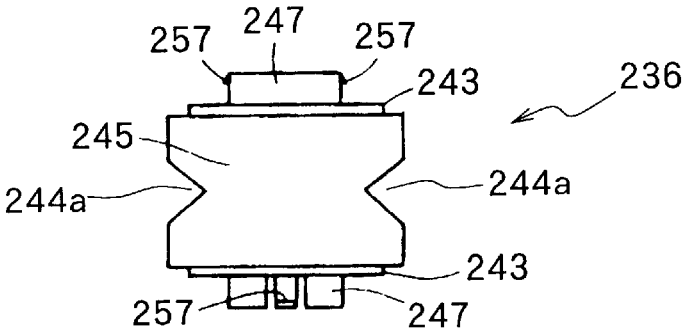
FIG. 22 is a plan view showing the sheet supply roller of FIG. 19 as viewed from above.
Figure 23:
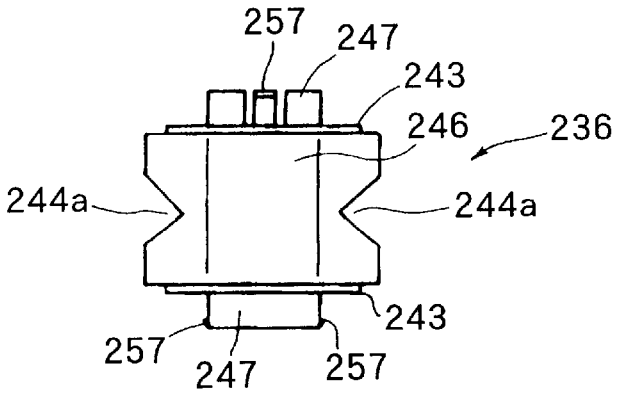
FIG. 23 is a plan view showing the sheet supply roller of FIG. 19 as viewed from below.
Figure 24:
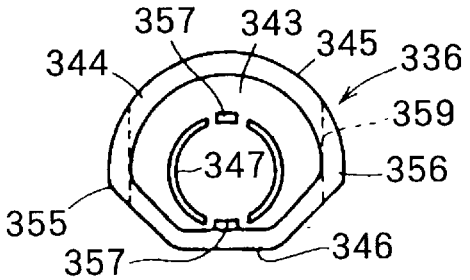
FIG. 24 is a plan view showing a sheet supply roller, as viewed from the left, according to a third modification of the embodiment of the present invention.
Figure 25:
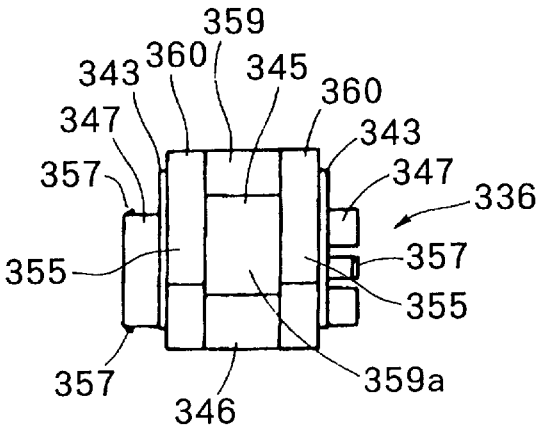
FIG. 25 is a plan view showing the sheet supply roller of FIG. 24 as viewed from the rear.
Figure 26:
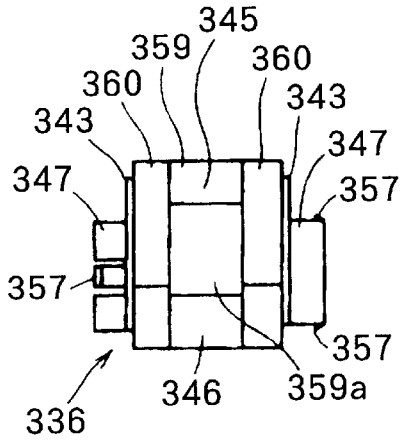
FIG. 26 is a plan view showing the sheet supply roller of FIG. 24 as viewed from the front.

Also, as shown in FIG. 21, a last contact portion 256 has edges 256*a* sandwiching the engraved portion. The contacting portion 256 has a width which decreases toward the edges 256*a* in the rotational direction R.

It should be noted that the first and last contact portions 255, 256 can be formed by molding processes so that the surface member 244 will have a predetermined shape instead of the cutting process.

Figure 27:
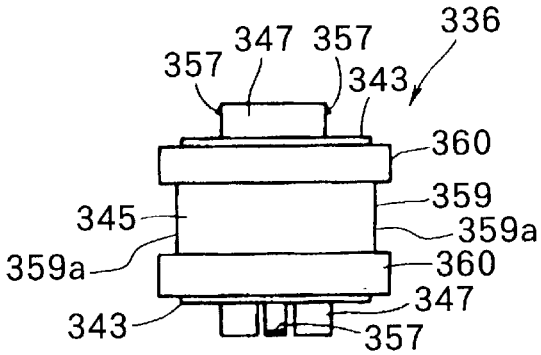
FIG. 27 is a plan view showing the sheet supply roller of FIG. 24 as viewed from above.
Figure 28:
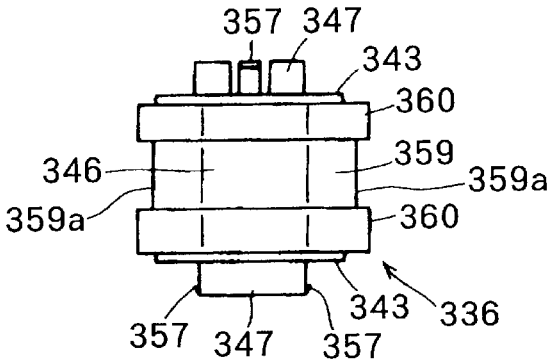
FIG. 28 is a plan view showing the sheet supply roller of FIG. 24 as viewed from below.

Next, a sheet supply roller 336 of the third modified embodiment will be described while referring to FIGS. 24 to 28. The sheet supply roller 336 is similar to the above-described sheet supply roller 36 except that the surface member 344 is formed from a plurality of segments. The surface member 344 has a circumferential surface 345 and a retracted surface 346. The circumferential surface 345 has a first contact portion 355 and a last contact portion 356. The core 343 has a pair of cylindrical members 347 integrally formed with the core 343 such that each cylindrical members 347 protrudes outwardly from a side surface of the core 343 in the widthwise direction. The cylindrical members 347 are formed with a stopper 357 that protrudes outward in the radial direction of the sheet supply roller 336. The surface member 344 has a middle segment 359 and a pair of side segments 360 sandwiching the middle segment 359 in the widthwise direction. Portions of the middle segment 359 are cut off so as to form retracted surfaces 359*a*. As shown in FIGS. 27 and 28, the retracted surfaces 359*a* are retracted from surfaces of the side segments 360 in the radial direction. In this way, first contacting portions 355 and last contacting portions 356 are formed on each side segment 360.

The sheet 27 is first fed only by the side segments 360 while the retracted surface 359*a* of the middle segment 259 confronts the sheet 27. Then, the sheet 27 is brought into contact with the middle segments while contacting the side segment 359 so that the sheet 27 is fed by both the middle and side segments 359, 360. When the sheet 27 comes in confrontation with the retracted surface 359*a* of the middle segment 359, then the sheet 27 is separated from the middle segment 359 and fed only by the side segments 360.

While the invention has been described in detail with reference to specific embodiments thereof, it would be apparent to those skilled in the art that various changes and modifications may be made therein without departing from the spirit of the invention, the scope of which is defined by the attached claims.

For example, in the above-described embodiments, the circumferential surface has first and last contact portions. However, the circumferential surface need have only either one of the first contact portion and the last contact portion.

What is claimed is:

1. A sheet supply unit comprising:

a sheet supply roller that feeds a recording medium in a sheet feed direction while rotating in a rotational direction, the sheet supply roller having a width in a widthwise direction perpendicular to the sheet feed direction and a peripheral member formed of a resilient material, the peripheral member having a circumferential surface that contacts with the recording medium and a retracted surface retracted radially inwardly from the circumferential surface, the circumferential surface being formed with a first contacting portion having a width in the widthwise direction, the width of the first contacting portion increasing in the rotational direction; and a separation pad disposed in confrontation with the peripheral member of the sheet supply roller.

2. The sheet supply unit according to claim 1, wherein the first contacting portion is formed by a cutting process in which a portion of the circumferential surface is cut away.

3. The sheet supply unit according to claim 1, wherein the first contacting portion has a forward edge positioned at a middle of the circumferential surface in the widthwise direction.

4. The sheet supply unit according to claim 1, wherein the first contacting portion has a forward edge positioned at a position deviated from a middle of the circumferential surface in the widthwise direction.

5. The sheet supply unit according to claim 1, wherein the sheet supply roller includes a plurality of segments arranged in the widthwise direction, each of the plurality of the segments having a peripheral member that has a circumferential surface and a retracted surface.

6. A sheet supply unit comprising:

a sheet supply roller that feeds a recording medium in a sheet feed direction while rotating in a rotational direction, the sheet supply roller having a width in a widthwise direction perpendicular to the sheet feed direction and a peripheral member formed of a resilient material, the peripheral member having a circumferential surface that contacts the recording medium and a retracted surface retracted radially inwardly from the circumferential surface, the circumferential surface being formed with a last contacting portion having a width in the widthwise direction, the width of the last contacting portion decreasing in the rotational direction, and a separation pad positioned in confrontation with the peripheral member of the sheet supply roller.

7. The sheet supply unit according to claim 6, wherein the last contacting portions is formed by a cutting process in which a portion of the circumferential surface is cut away.

8. The sheet supply unit according to claim 6, wherein the sheet supply roller includes a plurality of segments each having a peripheral member having a retracted surface and a circumferential surface, the plurality of the segments being arranged in the widthwise direction.

9. The sheet supply unit according to claim 6, wherein the last contacting portion has a rear edge positioned at a middle of the circumferential surface in the widthwise direction.

10. The sheet supply unit according to claim 6, wherein the first contacting portion has a rear edge positioned at a position deviated from a middle of the circumferential surface in the widthwise direction.

11. The sheet supply unit according to claim 6, wherein the circumferential surface further has a first contacting portion having a width that increases in the rotational direction.

12. The sheet supply unit according to claim 11, wherein the last contacting portion and the first contacting portion are formed by a cutting process in which portions of the circumferential surface are cut away.

13. The sheet supply unit according to claim 11, wherein the last contacting portion has a rear edge positioned at a middle of the circumferential surface in the widthwise direction, and the fist contacting portion has a forward edge positioned at a middle of the circumferential surface in the widthwise direction.

14. The sheet supply unit according to claim 6 further comprising:

a plate for mounting a plurality of recording mediums in a stacked condition;

a first urging member urging the plurality of recording mediums mounted on the plate toward the sheet supply roller;

a second urging member urging the separation pad toward the sheet supply roller; and a prevention member that prevents the retracted surface from contacting the separation pad when the retracted surface is brought into confrontation with the retracted surface.

15. An image forming device comprising:

a frame defining an internal space;

a sheet supply unit disposed in the internal space of the frame, the sheet supply unit supplying a recording medium in a sheet feed direction;

a print unit disposed in the internal space of the frame, the print unit printing an image on the recording medium supplied by the sheet supply unit; and a discharge member disposed in the internal space of the frame, the discharge member discharging the recording medium with an image formed thereon out of the frame;

wherein the sheet supply unit includes:

a sheet supply roller that feeds the recording medium in a sheet feed direction while rotating in a rotational direction and having a width in a widthwise direction perpendicular to the sheet feed direction, the sheet supply roller having a peripheral member formed of a resilient material, the peripheral member having a circumferential surface that contacts the recording medium and a retracted surface retracted radially inwardly from the circumferential surface, the circumferential surface being formed with a first contacting portion having a width in the widthwise direction, the width of the first contacting portion increases in the rotational direction; and a separation pad disposed in confrontation with the peripheral member of the sheet supply roller.

16. The image forming device according to claim 15, wherein the circumferential surface further has a last contacting portion having a width in the widthwise direction, the width of the last contacting portion decreasing in the rotational direction.

17. The image forming device according to claim 16, wherein the last contacting portions and the first contacting portions are formed by a cutting process in which portions of the circumferential surface are cut away.

18. The image forming device according to claim 16, wherein the last contacting portion has a rear edge positioned at a middle of the circumferential surface in the widthwise direction, and the first contacting portion has a forward edge positioned at a middle of the circumferential surface in the widthwise direction.

19. The image forming device according to claim 16, wherein the last contacting portion has a rear edge positioned at a position deviated from a middle of the circumferential surface in the widthwise direction, and the first contacting portion has a forward edge at a position deviated from a middle of the circumferential surface in the widthwise direction.

20. The image forming device according to claim 16, wherein the sheet supply roller has a plurality of segments each having a peripheral member having a circumferential surface and a retracted surface, the plurality of segments being arranged in the widthwise direction.

* * * * *